US012672716B2

(12) United States Patent
Friedman

(10) Patent No.: US 12,672,716 B2
(45) Date of Patent: Jul. 7, 2026

(54) BATHROOM

(71) Applicant: RH US, LLC, Corte Madera, CA (US)

(72) Inventor: Gary Friedman, Belvedere, CA (US)

(73) Assignee: RH US, LLC, Corte Madera, CA (US)

( * ) Notice: Subject to any disclaimer, the term of this patent is extended or adjusted under 35 U.S.C. 154(b) by 0 days.

(21) Appl. No.: 17/091,778

(22) Filed: Nov. 6, 2020

(65) Prior Publication Data

US 2022/0142359 A1 May 12, 2022

(51) Int. Cl.

| | |
|---|---|
| ***E04B 1/348*** | (2006.01) |
| ***A47B 67/00*** | (2006.01) |
| ***A47G 1/02*** | (2006.01) |
| ***A47K 1/02*** | (2006.01) |

(52) U.S. Cl.

CPC ..... *A47B 67/005* (2013.01); *A47G 1/02* (2013.01); *A47K 1/02* (2013.01); *E04B 1/348* (2013.01)

(58) Field of Classification Search

CPC ..... A47B 67/02; A47B 67/005; A47G 1/02; A47K 1/02; E04B 1/348

USPC ..... 312/224; 52/79.1, 204.5; 4/630

See application file for complete search history.

(56) References Cited

U.S. PATENT DOCUMENTS

| | | | | | |
|---|---|---|---|---|---|
| 4,840,000 | A * | 6/1989 | Grines | A47C 1/11 297/344.1 |
| 2007/0211181 | A1* | 9/2007 | Head | H04N 5/64 348/836 |
| 2008/0115266 | A1* | 5/2008 | Loberger | E03C 1/14 4/630 |
| 2011/0271441 | A1* | 11/2011 | Bayley | E03C 1/01 4/638 |

FOREIGN PATENT DOCUMENTS

| | | | | |
|---|---|---|---|---|
| CN | 86200468 U | | 11/1987 | |
| CN | 211484247 | * | 9/2020 | A47K 1/02 |
| JP | 5-253020 | * | 10/1993 | A47B 67/02 |
| JP | 9-168436 | * | 6/1997 | A47B 67/02 |
| JP | H11-229640 A | | 8/1999 | |
| JP | 2002-101976 | * | 4/2002 | A47B 67/02 |
| JP | 2002-101976 A | | 4/2002 | |
| JP | 2007-159844 A | | 6/2007 | |

OTHER PUBLICATIONS

Carla Aston Designed, "how to hang a mirror on a window | 12 bright, beautiful examples", carlaaston.com/designed/hang-mirror-on-window, Nov. 2018, 1 page.*

(Continued)

*Primary Examiner* — James O Hansen

(74) *Attorney, Agent, or Firm* — Womble Bond Dickinson (US) LLP

(57) ABSTRACT

A bathroom includes a series of walls defining interior space, the series of walls including an exterior wall. The bathroom also includes at least one window in the exterior wall, a vanity along the exterior wall, and at least one mirror above the vanity. A portion of the at least one window extends around a periphery of the at least one mirror in a front view such that natural ambient light entering the window passes around the periphery of the mirror, which may provide better illumination of a user than artificial light created by conventional bathroom lights.

6 Claims, 3 Drawing Sheets

(56) References Cited

OTHER PUBLICATIONS

Wayback machine, time stamp showing date ranges for Carla Aston Designed, Nov. 2018, 1 page.*
Houzz, Linda McDougald Design | Postcard from Paris Home, Hollingsworth Park, Traditional Bathroom, 3 pages, earliest known date is May 21, 2013. https://www.houzz.com/photos/city-hollingsworth-park-traditional-bathroom-phvw-vp~3948120 (Year: 2013).*
Gallery of STAAB Residence / Chen + Suchart Studio LLC @ Matt Winquist (p. 17/32) (Year: 2013).*
MECC Interiors Inc. "placing mirrors in front of windows", by Christina Mogk, May 13, 2015 (Figures 1-5). https://meccinteriors.com/designbites/placing-mirrors-in-front-of-windows/ (Year: 2015).*
Draggy, "25 Amazing Bathroom Light Ideas", Apr. 2, 2014, https://www.architectureartdesigns.com/25-amazing-bathroom-light-ideas/. (Year: 2014).*
Extended European Search Report for Application No. 21206781.3, mailed Mar. 10, 2022, 7 pages.
Anonymous: "placing mirrors in front of windows," mecc interiors inc. https://meccinteriors.com/designbites/placing-mirrors-in-front-of-windows/, Retrieved Feb. 28, 2022, 18 pages.
Canadian Examiner's Report for Application No. 3,138,021 dated Jan. 6, 2023, 4 pages.
Chinese Office action for Application No. 2021113169944, mailed Nov. 13, 2023, 8 pages.

* cited by examiner

BATHROOM

BACKGROUND

1. Field

The present disclosure relates generally to aspects of a bathroom.

2. Description of Related Art

Bathrooms have a variety of different configurations and a variety of different layouts of the fixtures therein. However, conventional bathrooms typically include a vanity and a mirror mounted to the wall above vanity. Additionally, many conventional bathrooms include a series of lights above the mirror and/or around the perimeter of the mirror to provide artificial light to illuminate the user's face in the mirror. Other conventional bathrooms may include a small portable mirror on the countertop of the vanity with a built-in light around the perimeter of the mirror. However, in both of these conventional bathrooms, the artificial light may inadequately illuminate the user because artificial light, unlike natural light, covers only a portion of the visible spectrum.

SUMMARY

Embodiments of the present disclosure are directed to various aspects of a bathroom. In one embodiment, the bathroom includes an exterior wall, at least one window in the exterior wall, a vanity along the exterior wall, and at least one mirror above the vanity. A portion of the window extends around a periphery of the mirror in a front view.

A shape of the mirror may correspond to a shape of the window. The shape of the mirror may be rectangular.

A size of the mirror may be smaller than a size of the window.

The bathroom may also include an upper support coupling an upper edge of the mirror to a windowsill of the window.

The bathroom may also include a lower support coupling a lower edge of the mirror to a vanity countertop of the vanity.

The mirror may be laterally and vertically centered with respect to the window.

The at least one mirror may include a first mirror and a second mirror, and the at least one window may include a first window and a second window.

The vanity may include a base defining a central opening and first and second floor supports on opposite sides of the central opening, a vanity countertop defining first and second sinks, and first and second faucets coupled to the vanity countertop proximate to the first and second sinks.

The bathroom may also include a seat, and the central opening may be configured to accommodate the seat.

A length of the vanity may extend from an outer edge of a first windowsill around the first window to an outer edge of a second windowsill around the second window.

The first mirror may be laterally aligned with the first sink and the first set of shelves, and the second mirror may be laterally aligned with the second sink and the second set of shelves.

A bathroom according to another embodiment of the present disclosure includes a series of walls, including at least one exterior wall, defining an interior space, at least a first window and a second window in the exterior wall, a vanity along the exterior wall, and at least a first mirror and a second mirror above the vanity. A portion of the first window extends around a periphery of the first mirror in a front view, and a portion of the second window extends around a periphery of the second mirror in a front view.

A shape of the first mirror may correspond to a shape of the first window, and a shape of the second mirror may correspond to a shape of the second window.

The shape of each of the first mirror and the second mirror may be rectangular.

A size of the first mirror may be smaller than a size of the first window, and a size of the second mirror may be smaller than a size of the second window.

The bathroom may also include a first upper support coupling an upper edge of the first mirror to a first windowsill of the first window, and a second upper support coupling an upper edge of the second mirror to a second windowsill of the second window.

The bathroom may include a first lower support coupling a lower edge of the first mirror to a vanity countertop of the vanity, and a second lower support coupling a lower edge of the second mirror to the vanity countertop of the vanity.

The first mirror may be laterally and vertically centered with respect to the first window, and the second mirror may be laterally and vertically centered with respect to the second window.

The vanity may include a base defining a central opening and first and second floor supports on opposite sides of the central opening, a seat accommodated in the central opening, a vanity countertop defining first and second sinks, and first and second faucets coupled to the vanity countertop proximate to the first and second sinks. A length of the vanity may extend from an outer edge of a first windowsill around the first window to an outer edge of a second windowsill around the second window.

This summary is provided to introduce a selection of features and concepts of embodiments of the present disclosure that are further described below in the detailed description. This summary is not intended to identify key or essential features of the claimed subject matter, nor is it intended to be used in limiting the scope of the claimed subject matter. One or more of the described features may be combined with one or more other described features to provide a workable device.

BRIEF DESCRIPTION OF THE DRAWINGS

These and other features and advantages of embodiments of the present disclosure will become more apparent by reference to the following detailed description when considered in conjunction with the following drawings. In the drawings, like reference numerals are used throughout the FIGURES to reference like features and components. The figures are not necessarily drawn to scale.

DETAILED DESCRIPTION

Embodiments of the present disclosure relate to various aspects of a bathroom. In one or more embodiments, the bathroom includes a vanity and at least one mirror on the vanity that at least partially overlaps a window such that natural ambient light enters the window and passes around at least a portion of a periphery of the mirror, which may provide better illumination of a user than artificial light created by conventional bathroom lights.

Figure 1:
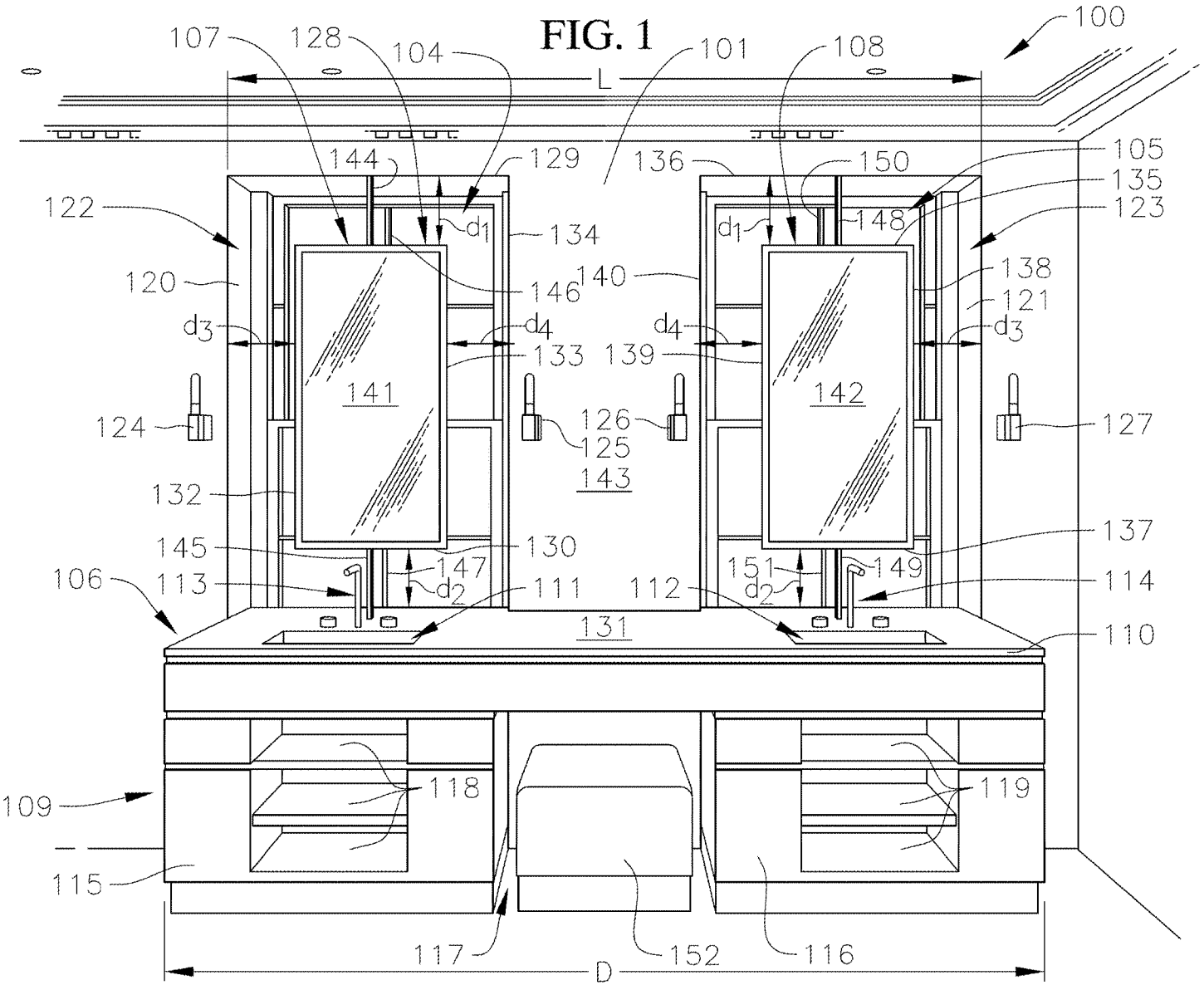
FIGS. 1-3 are a front view, a side perspective view, and a top layout view, respectively, of a bathroom according to one embodiment of the present disclosure.
Figure 2:
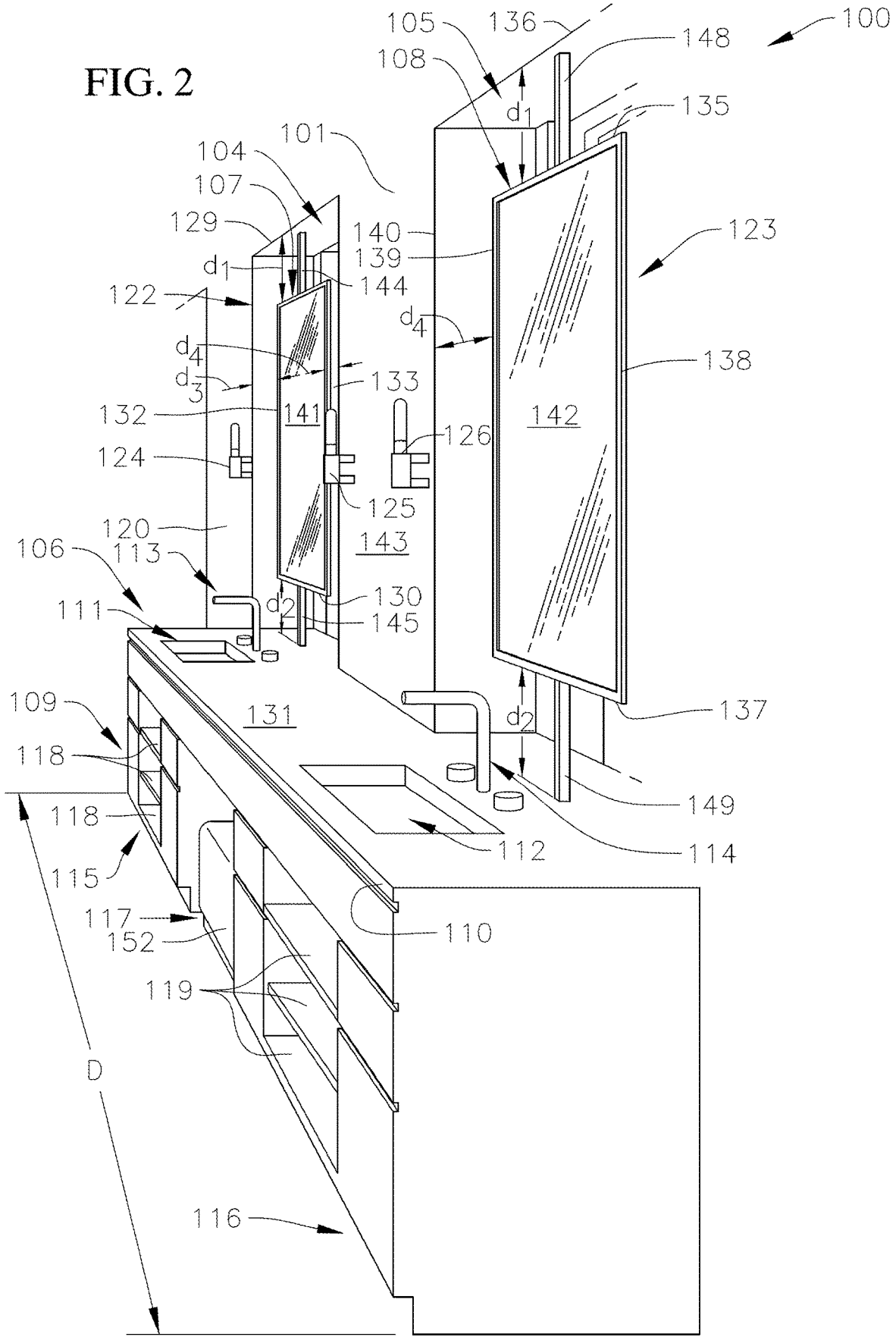
Figure 3:
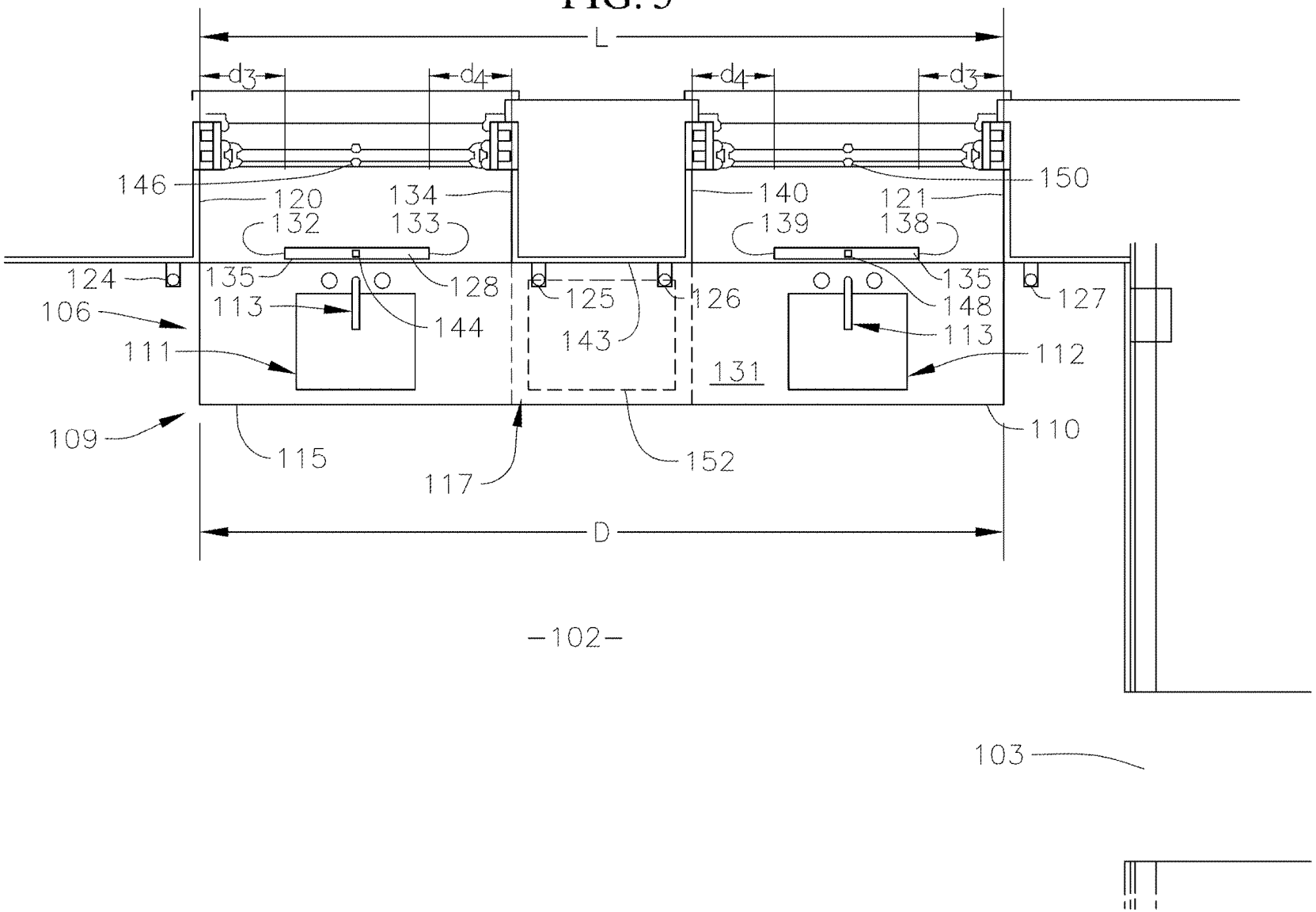

With reference now to the embodiment illustrated in FIGS. 1-3, a bathroom 100 according to one embodiment of the present disclosure includes a series of walls (at least one of which is an exterior wall 101) defining an interior space 102, a doorway 103 in one of the walls connecting the interior space 102 to another room (e.g., a living room), a pair of windows 104, 105 in the exterior wall 101, a vanity 106 along a portion of the exterior wall 101 in which the windows are located, and a pair of mirrors 107, 108 above the vanity 106. Although in the illustrated embodiment the bathroom 100 includes a pair of windows 104, 105 in the exterior wall 101 and a pair of mirrors 107, 108, in one or more embodiments, the bathroom 100 may include any other suitable number of windows in the exterior wall 101 101 and any other suitable number of mirrors above the vanity 106. For instance, in one or more embodiments, the bathroom 100 may include a single mirror above the vanity 106 and a single window in the exterior wall 101. As used herein, the number of windows in the exterior wall 101 refers to the number of windows in a portion of the exterior wall 101 along which the vanity 106 is located. Although in the illustrated embodiment the number of mirrors 107, 108 corresponds to the number of windows 104, 105 in the exterior wall 101 along which the vanity 106 is positioned, in one or more embodiments, the number of mirrors 107, 108 above the vanity 106 may differ from the number of windows 104, 105 in the exterior wall 101 along which the vanity 106 is located. In one or more embodiments, the number of mirrors 107, 108 above the vanity 106 may be greater than the number of windows in the exterior wall 101 along which the vanity 106 is positioned, or the number of mirrors 107, 108 above the vanity 106 may be less than the number of windows 104, 105 in the exterior wall 101 along which the vanity 106 is positioned.

In the illustrated embodiment, the vanity 106 includes a base 109 and a vanity countertop 110 on the base 109. In the illustrated embodiment, the vanity countertop 110 including a pair of sinks 111, 112 and a pair of corresponding faucets 113, 114, and the base 109 includes a first floor support 115 and a second floor support 116 on opposite sides of a central opening 117 that accommodates a seat (e.g., a stool or bench) 152. In the illustrated embodiment, the central opening 117 for accommodating the seat 152 is laterally centered or substantially laterally centered on the base 109. In the illustrated embodiment, the configuration of the first floor support 115 is symmetric to the configuration of the second floor support 116 about a lateral centerline of the vanity 106. Additionally, in the illustrated embodiment, each of the first and second floor supports 115, 116 defines a series of interior shelves or compartments 118, 119, respectively, configured to accommodate, for example, towels and/or toiletries. Although in the illustrated embodiment each of the first and second floor supports 115, 116 defines three interior shelves 118, 119 (e.g., the base defines three shelves or compartments 118 at one side of the central opening 117 and three shelves or compartments 119 at the other side of the central opening 117), in one or more embodiments, the first and second floor supports 115, 116 of the base 109 may define any other suitable number of interior shelves 118, 119. Additionally, in one or more embodiments, the base 109 of the vanity 106 may include cabinets and/or drawers in addition to or instead of the interior shelves. Furthermore, in the illustrated embodiment, the first sink 111 and the first faucet 113 are laterally aligned or substantially laterally aligned (e.g., centered or substantially centered) with the first floor support 115 and the interior shelves 118 defined therein, and the second sink 112 and the second faucet 114 are laterally aligned or substantially laterally aligned (e.g., centered or substantially centered) with the second floor support 116 and the interior shelves 119 defined therein.

In the illustrated embodiment, the vanity 106 is centered or substantially centered with respect to the windows 104, 105 in the exterior wall 101. Additionally, in the illustrated embodiment, the vanity 106 has a length L that is equal or substantially equal to a distance D along the exterior wall 101 between outer side edges 120, 121 of window sills 122, 123 around the windows 104, 105 (e.g., the vanity 106 extends from an outer side edge 120 of the first window sill 122 around the first window 104 to an outer side edge 121 of the second windowsill 123 around the second window 105). Further, in the illustrated embodiment, a width of the first floor support 115 is equal or substantially equal to a width of the first windowsill 122, a width of the second floor support 116 is equal or substantially equal to a width of the second windowsill 123, and a width of the central opening 117 in the vanity 106 is equal or substantially equal to a width of the exterior wall 101 between the adjacent windows 104, 105 in the exterior wall 101.

In the illustrated embodiment, the bathroom 100 also includes a series of lights coupled to the exterior wall 101. In the illustrated embodiment, the bathroom 100 includes a first pair of lights 124, 125 coupled to the exterior wall 101 on opposite sides of the first window 104, and a second pair of lights 126, 127 coupled to the exterior wall 101 on opposite sides of the second window 105. Additionally, in the illustrated embodiment, the lights 124-127 are vertically centered or substantially vertically centered along the windows 104, 105 and the mirrors 107, 108. In one or more embodiments, the bathroom 100 may include any other suitable number of lights 124-127 coupled to the exterior wall 101 and the lights 124-127 may be arranged in any other suitable arrangement on the exterior wall 101 depending, for instance, on the desired illumination of the user using the vanity 106 and/or the mirrors 107, 108.

In the illustrated embodiment, the first mirror 107 is positioned in front of the first window 104 in the exterior wall 101 and the first mirror 107 is smaller than the first window 104 (e.g., a height and a width of the first mirror 107 are less than a height and a width, respectively, of the first window 104). In the illustrated embodiment, the first mirror 107 is centered or substantially centered on the first window 104 (e.g., the first mirror 107 is laterally and vertically centered or substantially laterally and vertically centered on the first window 104). In the illustrated embodiment, a distance d1 between an upper edge 128 of the first mirror 107 and an upper edge 129 of the first windowsill 122 facing the upper edge 128 of the first mirror 107 is equal or substantially equal to a distance d2 between a lower edge 130 of the first mirror 107 and an upper surface 131 of the vanity countertop 110 facing the lower edge 130 of the first mirror 107, a distance d3 between an outer side edge 132 of the first mirror 107 and the outer side edge 120 of the first windowsill 122 facing the outer side edge 132 of the first mirror 107, and a distance d4 between an inner side edge 133 of the first mirror 107 and an inner side edge 134 of the first windowsill 122 facing the inner side edge 133 of the first mirror 107. Accordingly, in the illustrated embodiment, a portion of the first window 107 extends around the outer periphery of the first mirror 107 in a front view (see FIG. 1), and therefore natural ambient light entering the bathroom 100 through the first window 104 passes around the outer periphery of the first mirror 107. When a user is standing in front of the first mirror 107, the natural ambient light entering the bathroom 100 through the first window 107 and around the outer periphery of the first mirror 107 is configured to illuminate the user's face in the first mirror 107, which may provide better illumination than artificial light created by the lights 124, 125 in the interior of the bathroom 100. Moreover, centering the first mirror 107 with respect to the first window 104 such that the spacing between the edges 128, 132, 133 of the first mirror 107 and the corresponding edges 129, 120, 134 of the first windowsill 122 and the spacing between the lower edge 130 of the first mirror 107 and the upper surface 131 of the vanity countertop 106 is uniform or substantially uniform (i.e., constant or substantially constant) is configured to permit uniform or substantially uniform natural illumination around the periphery of the first mirror 107.

Similarly, in the illustrated embodiment, the second mirror 108 is positioned in front of the second window 105 in the exterior wall 101 and the second mirror 108 is smaller than the second window 105 (e.g., a height and a width of the second mirror 108 are less than a height and a width, respectively, of the second window 105). In the illustrated embodiment, the second mirror 108 is centered or substantially centered on the second window 105 (e.g., the second mirror 108 is laterally and vertically centered or substantially laterally and vertically centered on the second window 105). In the illustrated embodiment, a distance d1 between an upper edge 135 of the second mirror 108 and an upper edge 136 of the second windowsill 123 facing the upper edge 135 of the second mirror 108 is equal or substantially equal to a distance d2 between a lower edge 137 of the second mirror 108 and the upper surface 131 of the vanity countertop 110 facing the lower edge 137 of the second mirror 108, a distance d3 between an outer side edge 138 of the second mirror 108 and the outer side edge 121 of the second windowsill 123 facing the outer side edge 138 of the second mirror 108, and a distance d4 between an inner side edge 139 of the second mirror 108 and an inner side edge 140 of the second windowsill 123 facing the inner side edge 139 of the second mirror 108. Accordingly, in the illustrated embodiment, a portion of the second mirror 108 extends around the outer periphery of the second mirror 108 in a front view (see FIG. 1), and therefore natural ambient light entering the bathroom 100 through the second window 105 passes around the outer periphery of the second mirror 108. When a user is standing in front of the second mirror 108, the natural ambient light entering the bathroom 100 through the second window 105 and around the outer periphery of the second mirror 108 is configured to illuminate the user's face in the second mirror 108, which may provide better illumination than artificial light created by the lights 126, 127 in the interior of the bathroom 100. Moreover, centering the second mirror 108 with respect to the second window 105 such that the spacing between the edges 135, 138, 139 of the second mirror 108 and the corresponding edges 136, 121, 140 of the second windowsill 123 and the spacing between the lower edge 137 of the second mirror 108 and the upper surface 131 of the vanity countertop 106 is uniform or substantially uniform (i.e., constant or substantially constant) is configured to permit uniform or substantially uniform natural illumination around the periphery of the second mirror 108.

In the illustrated embodiment, the shape of the mirrors 107, 108 corresponds to (e.g., matches) the shape of the windows 104, 105, respectively, in front of which the mirrors 107, 108 are positioned. In the illustrated embodiment, the mirrors 107, 108 and the windows 104, 105 are rectangular, although in one or more embodiments, the mirrors 107, 108 and the windows 104, 105 may have any other suitable shape, such as square or circular. In one or more embodiments, the shape of the mirror 107, 108 may not correspond to the shape of the window 104, 105 in front of which it is positioned. For instance, in one or more embodiments, the windows 104, 105 may be rectangular and the mirrors 107, 108 may be square or circular. Additionally, although in the illustrated embodiment the shapes of the first and second mirrors 107, 108 are identical, in one or more embodiments, the shape of the first mirror 107 may differ from the shape of the second mirror 108.

In the illustrated embodiment, front faces 141, 142 of the mirrors 107, 108, respectively, are co-planar or substantially co-planar with an inner surface 143 of the exterior wall 101 (e.g., the mirrors 107, 108 are flush or substantially flush with the inner surface 143 of the exterior wall 101). In one or more embodiments, the mirrors 107, 108 may not be co-planar with the inner surface 143 of the exterior wall 101. For example, in one or more embodiments, the first mirror 107 and/or the second mirror 108 may be recessed relative to the inner surface 143 of the exterior wall 101 (e.g., the first mirror 107 and/or the second mirror 108 may extend into the first windowsill 122 and/or the second windowsill 123). In one or more embodiments, the first mirror 107 and/or the second mirror 108 may project or protrude into the interior space beyond the inner surface 143 of the exterior wall 101 (e.g., the first mirror 107 and/or the second mirror 108 may be spaced inward apart from the inner surface 143 of the exterior wall 101).

In the illustrated embodiment, the first mirror 107 is supported by an upper support member 144 connecting the upper edge 128 of the first mirror 107 to the upper edge 129 of the first windowsill 122 around the first window 104, and a lower support member 145 connecting the lower edge 130 of the first mirror 107 to the vanity countertop 110 (e.g., the upper surface 131 of the vanity countertop 110). In the illustrated embodiment, the upper and lower support members 144, 145 are vertical or substantially vertical members, and the upper support member 144 is aligned or substantially aligned with the lower support member 145. Additionally, in the illustrated embodiment, the upper and lower support members 144, 145 are laterally centered or substantially laterally centered on the first mirror 107 and the first window 104. Additionally, in the illustrated embodiment, the upper and lower support members 144, 145 are aligned or substantially aligned with upper and lower vertical window grilles 146, 147, respectively, in the first window 104. Accordingly, in the illustrated embodiment, the upper and lower support members 144, 145 do not obstruct or substantially do not obstruct light entering the first window 104 because the light is already obstructed by the upper and lower vertical window grilles 146, 147. Furthermore, in the illustrated embodiment, the lower support member is 145 laterally aligned or substantially laterally aligned with the first faucet 113.

Similarly, in the illustrated embodiment, the second mirror 108 is supported by an upper support member 148 connecting the upper edge 135 of the second mirror 108 to the upper edge 136 of the second windowsill 123 around the second window 105, and a lower support member 149 connecting the lower edge 137 of the second mirror 108 to the vanity countertop 110 (e.g., the upper surface 131 of the vanity countertop 110). In the illustrated embodiment, the upper and lower support members 148, 149 are vertical or substantially vertical members, and the upper support member 148 is aligned or substantially aligned with the lower support member 149. Additionally, in the illustrated embodiment, the upper and lower support members 148, 149 are laterally centered or substantially laterally centered on the second mirror 108 and the second window 105. Additionally, in the illustrated embodiment, the upper and lower support members 148, 149 are aligned or substantially aligned with upper and lower vertical window grilles 150, 151, respectively, in the second window 105. Accordingly, in the illustrated embodiment, the upper and lower members 148, 149 do not obstruct or substantially do not obstruct light entering the second window 105 because the light is already obstructed by the upper and lower vertical window grilles 150, 151. Furthermore, in the illustrated embodiment, the lower support member is 149 laterally aligned or substantially laterally aligned with the second faucet 114.

While this invention has been described in detail with particular references to exemplary embodiments thereof, the exemplary embodiments described herein are not intended to be exhaustive or to limit the scope of the invention to the exact forms disclosed. Moreover, although the invention is described herein for use as a bathroom, one of skill in the art would appreciate that the design features could be applied to other living spaces, for example, an apartment or other structure with living quarters. Furthermore, the design could be applied to any room having a mirror, for example, a living room, a dining room, or even an office building. Persons skilled in the art and technology to which this invention pertains will appreciate that alterations and changes in the described structures can be practiced without meaningfully departing from the principles, spirit, and scope of this invention, as set forth in the following claims. Additionally, as used herein, the term "substantially" and similar terms are used as terms of approximation and not as terms of degree, and are intended to account for the inherent deviations in measured or calculated values that would be recognized by those of ordinary skill in the art. Furthermore, as used herein, when a component is referred to as being "on" another component, it can be directly on the other component or components may also be present therebetween. Moreover, when a component is component is referred to as being "coupled" to another component, it can be directly attached to the other component or intervening components may be present therebetween.

What is claimed is:

1. A bathroom consisting of:

a plurality of walls defining an interior space, the plurality of walls comprising an exterior wall and an interior wall;

a doorway in the interior wall, the doorway connecting the interior space to another room;

a first window and a second window in the exterior wall, the first window comprising at least one first upper vertical window grille and the second window comprising at least one second upper vertical window grille;

a vanity along the exterior wall, the vanity comprising:

a base defining a central opening and first and second floor supports on opposite sides of the central opening;

a vanity countertop defining first and second sinks, wherein the vanity countertop:

extends continuously between the first and second sinks, a first portion of the vanity countertop, behind the first sink, extending past an inner surface of the exterior wall and toward the first window, and a second portion of the vanity countertop, behind the second sink, extending past the inner surface of the exterior wall and toward the second window;

first and second faucets coupled to the vanity countertop proximate to the first and second sinks; and a seat accommodated in the central opening, wherein the seat and the central opening are centered between the first and second sinks;

a first mirror and a second mirror above the vanity;

a first upper support member coupling an upper edge of the first mirror to a first windowsill of the first window;

a second upper support member coupling an upper edge of the second mirror to a second windowsill of the second window;

a first lower support member coupling a lower edge of the first mirror to the first portion of the vanity countertop of the vanity;

a second lower support member coupling a lower edge of the second mirror to the second portion of the vanity countertop of the vanity;

a first pair of lights coupled to the exterior wall on opposite sides of the first window and the first mirror, wherein the first pair of lights is substantially vertically centered along the first window and the first mirror; and a second pair of lights coupled to the exterior wall on opposite sides of the second window and the second mirror, wherein the second pair of lights is substantially vertically centered along the second window and the second mirror, wherein a portion of the first window extends around a periphery of the first mirror such that the portion of the first window is visible around the first mirror in a front view, wherein a portion of the second window extends around a periphery of the second mirror such that the portion of the second window is visible around the second mirror in a front view, wherein front surfaces of the first and second mirrors are co-planar with the inner surface of the exterior wall, wherein each of the first mirror and second mirror above the vanity is in front of one of the first window and second window in the exterior wall, wherein a number of the first mirror and second mirror above the vanity is equal to a number of the first window and second window above the vanity, wherein the first upper support member is aligned with the at least one first upper vertical window grille, wherein the second upper support member is aligned with the at least one second upper vertical window grille, wherein the first faucet is aligned with the first lower support member, wherein the second faucet is aligned with the second lower support member, wherein the first mirror is laterally and vertically centered with respect to the first window such that a first distance between an upper edge of the first mirror and an upper edge of the first windowsill, a second distance between a lower edge of the first mirror and an upper surface of the vanity countertop, a third distance between an outer side edge of the first mirror and an outer side edge of the first windowsill, and a fourth distance between an inner side edge of the first mirror and an inner side edge of the first windowsill are substantially equal, wherein the second mirror is laterally and vertically centered with respect to the second window such that a first distance between an upper edge of the second mirror and an upper edge of the second windowsill, a second distance between a lower edge of the second mirror and an upper surface of the vanity countertop, a third distance between an outer side edge of the second mirror and an outer side edge of the second windowsill, and a fourth distance between an inner side edge of the second mirror and an inner side edge of the second windowsill are substantially equal, wherein the seat and the central opening are centered along the portion of the exterior wall between the first window and the second window, and wherein a width of the central opening is substantially equal to a width of the portion of the exterior wall between the first window and the second window.

2. The bathroom of claim 1, wherein the first mirror is laterally aligned with the first sink, and wherein the second mirror is laterally aligned with the second sink.

3. The bathroom of claim 1, wherein a shape of the first mirror corresponds to a shape of the first window, and wherein a shape of the second mirror corresponds to a shape of the second window.

4. The bathroom of claim 3, wherein the shape of each of the first mirror and the second mirror is rectangular.

5. The bathroom of claim 1, wherein a size of the first mirror is smaller than a size of the first window, and wherein a size of the second mirror is smaller than a size of the second window.

6. The bathroom of claim 1, wherein a length of the vanity extends from an outer edge of the first windowsill around the first window to an outer edge of the second windowsill around the second window.

* * * * *